US012774137B2

(12) United States Patent
Gates

(10) Patent No.: US 12,774,137 B2
(45) Date of Patent: Oct. 27, 2026

(54) SECURE LID

(71) Applicant: ALL SEASONS FEEDERS, LTD., San Antonio, TX (US)

(72) Inventor: William Zachary Gates, San Antonio, TX (US)

(73) Assignee: ALL SEASONS FEEDERS, LTD., San Antonio, TX (US)

( * ) Notice: Subject to any disclaimer, the term of this patent is extended or adjusted under 35 U.S.C. 154(b) by 0 days.

(21) Appl. No.: 18/610,396

(22) Filed: Mar. 20, 2024

(65) Prior Publication Data

US 2025/0296744 A1 Sep. 25, 2025

(51) Int. Cl.
*B65D 50/04* (2006.01)

(52) U.S. Cl.
CPC ..... *B65D 50/046* (2013.01); *B65D 2215/02* (2013.01); *B65D 2543/00203* (2013.01)

(58) Field of Classification Search
CPC ..... B65D 50/046; B65D 2215/02; B65D 2543/00203
USPC ..... 220/323, 324, 326, 315
See application file for complete search history.

(56) References Cited

U.S. PATENT DOCUMENTS

| | | | | |
|---|---|---|---|---|
| 4,202,574 | A * | 5/1980 | Redmayne | E05B 65/006 292/201 |
| 4,986,220 | A | 1/1991 | Reneau et al. | |
| 6,763,781 | B1 | 7/2004 | Norrell | |
| 2005/0006390 | A1* | 1/2005 | Wang | B65D 45/30 220/326 |
| 2006/0283396 | A1 | 12/2006 | Hernandez | |
| 2007/0175898 | A1* | 8/2007 | Craft | B65F 1/1468 220/324 |
| 2011/0088627 | A1 | 4/2011 | Gates | |
| 2012/0085289 | A1 | 4/2012 | Quiring et al. | |

OTHER PUBLICATIONS

International Search Report and Written Opinion dated Jan. 27, 2026 from international application PCT/US2025/057076 (13 pages).

* cited by examiner

*Primary Examiner* — Jeffrey R Allen
(74) *Attorney, Agent, or Firm* — Braxton IP PLLC

(57) ABSTRACT

A system for a lid is disclosed. The system includes a container with an upstream top and an opposing downstream top. The lid couples with the container. The lid has an upstream side and an opposing downstream side. The downstream side has an inwardly extending lip, and the upstream side has an inwardly extending lip. The downstream top has a moveable bolt which engages with said inwardly extending lip on the downstream side. The downstream side has a shelf which engages with the inwardly extending lip on said upstream side.

10 Claims, 4 Drawing Sheets

SECURE LID

BACKGROUND OF THE INVENTION

Technical Field

The present invention relates to a system and method for securing a lid.

Description of Related Art

Lids cover objects and offer protection. Lids can cover or house a host of objects including animal feeders. Animals can inadvertently, or intentionally, remove the lids and retrieve the food therein. Consequently, there is a need for a system and method for securing a lid so that it cannot be easily or accidentally removed.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
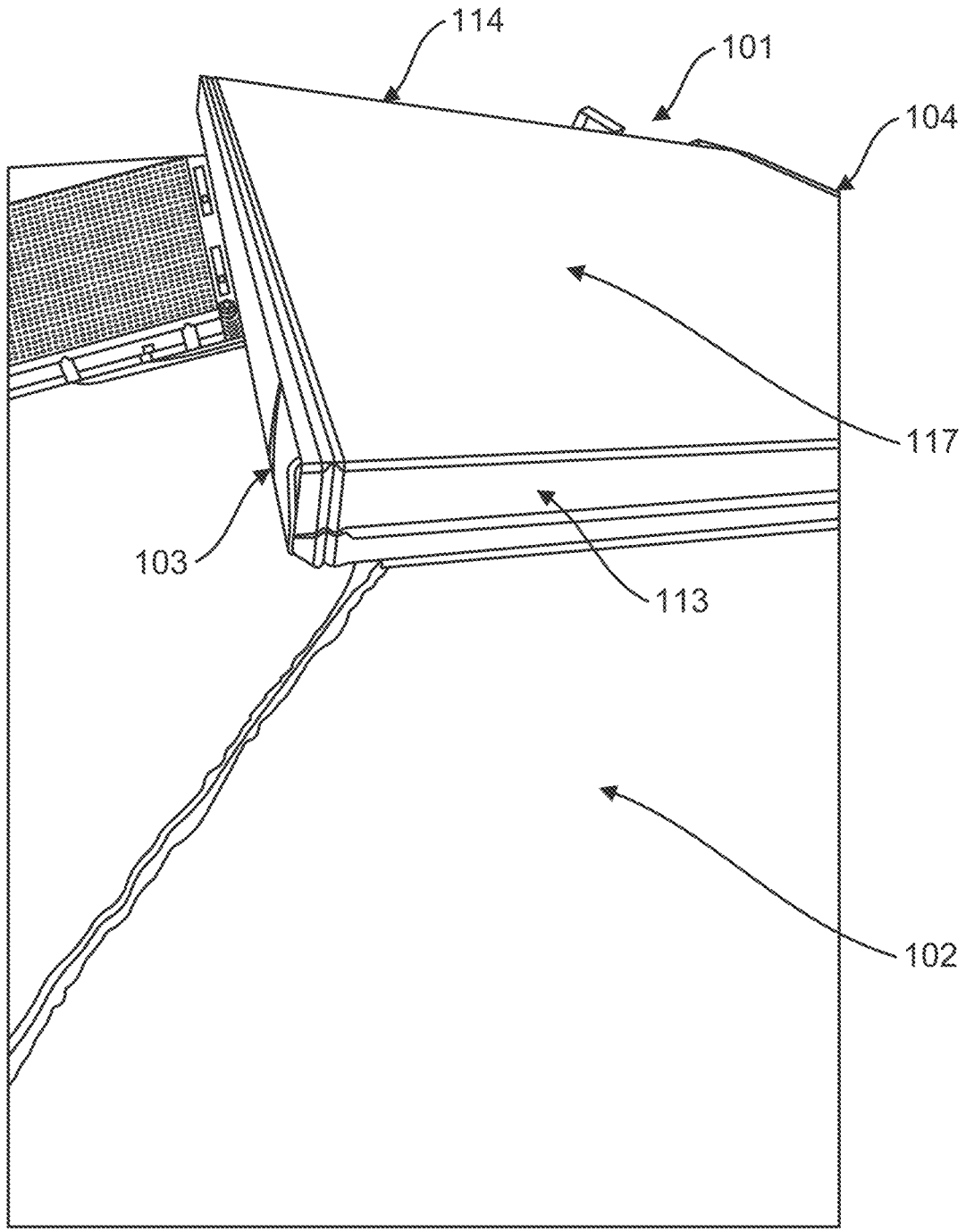
FIG. 1 is a perspective view of the secure lid in one embodiment.

FIG. 1 is a perspective view of the secure lid in one embodiment. The lid 101 is coupled to a container of some sort. As depicted, the container is an animal feeder 102, such as a deer feeder. A feeder 102 houses feed which is dispensed for animals. While a feeder 102 is depicted, this is for illustrative purposes only and should not be deemed limiting. The lid system discussed herein can be used to house and contain virtually any container.

The feeder 102 typically houses animal feed. As such, many animals attempt to open the container to have access to the feed therein. Often an animal that is not the intended beneficiary of the feed will attempt to enter the feeder. As but on example, if the feeder 102 is a deer feeder, racoons and other animals will attempt to open the lid to gain access to the food within the feeder.

Aside from advantageous animals, a typical lid can be undesirably removed by other forces such as wind, rain, etc. The lid 101 being removed is undesirable for a host of reasons. One reason is that the contents of the container, the feeder 102 in this example, is then open and exposed to the elements. A lid 101 will keep the contents dry and covered from the rain. However, if removed, accidentally or intentionally, the contents are not subject to getting wet due to the rain, and possible spoilage. This is undesirable.

FIG. 1 depicts a secure lid which can be safely and easily secured and removed from a container. As shown the lid 101 has a square cross-section. This is because it is made to fit the cross-section of the opening of the container. The size and shape of the lid 101 can vary depending upon the application.

As shown the lid 101 has four sides. The lid has an upstream side 103, an opposing downstream side 104, a front side 113, and an opposing rear side 114. As shown the upstream side 103 and downstream side 104 are parallel. The front side 113 and the rear side 114 are parallel. The front side 113 is approximately perpendicular to the upstream side 103. As used herein, upstream and downstream refer to relative locations on the lid, feeder, etc. An upstream end will be on the left side whereas the downstream end will be on the right side. As will be described in more detail herein, the downstream side 104 is the side adjacent to a locking mechanism, such as a spring. Conversely, the upstream side 103 is the side furthest away from the locking mechanism.

The lid 101 sides extend downwardly from a lid top 117 which connects and extends to each side. In one embodiment each side extends downwardly approximately perpendicular from the lid top 117. As noted, while a square or rectangular shape has been shown, this is for illustrative purposes only and should not be deemed limiting. Virtually any shape can be utilized. So long as the lid 101 has at least two sides which can interact with the bolt 105 and the shelf 109, as described in more detail below, the lid 101 can function as described herein.

As can be seen in FIG. 1, the lid 101 sits atop the feeder 102 and closes the opening in the feeder 102. When closed, as depicted, the lid 101 is referred to as being in the closed position.

Figure 2:
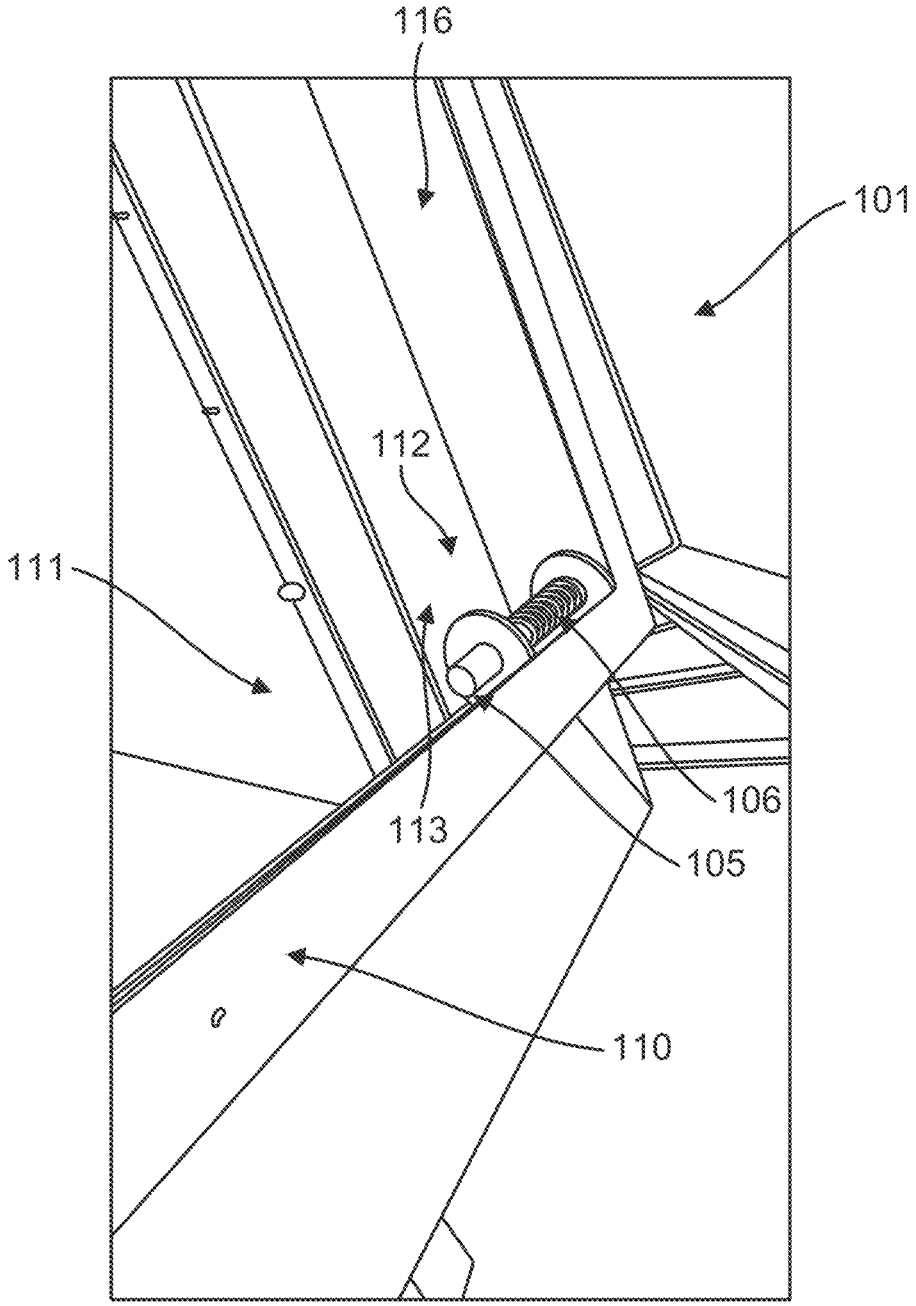
FIG. 2 is a perspective top view of the secure lid with the lid partially removed in one embodiment.

FIG. 2 is a perspective top view of the secure lid with the lid partially removed in one embodiment. FIG. 2 shows the lid 101 with the upstream end being partially removed from the feeder. The top 110 of the opening 111 is what the lid 101 rests upon. The opening 111 is the void of the container/feeder 102 which can be filled with an object, such as feed.

The top 110, as shown and in one embodiment, follows the outer periphery of the opening 111. In the embodiment depicted, the top 110 has four sides and is in the shape of a square. Thus, the top 110 has an upstream side, downstream side, front side, and rear side. Consequently, the lid 101 also has four sides and is shaped like a square.

A downstream end of the top 110 has a locking mechanism 112. A locking mechanism, as used herein, refers to an object which applies an outward force on the downstream side 104 of a lid which helps secure the lid 101 remain closed. The locking mechanism 112 can comprise a variety of methods. In the embodiment depicted the locking mechanism 112 comprises a bolt member 105 and a spring 106. The spring 106 urges the bolt 105 outward away from the opening. The bolt 105 then interacts with a lip 108 (not depicted in FIG. 2) on the lid 101 which prevents the lid 101 from opening.

As shown the locking mechanism 112 comprises a fixed anchor 113. The spring 106 is coupled to the fixed anchor 113. The spring 106 seeks to expand outward. Due to the fixed anchor 113, the spring is forced to expend outward toward the downstream end of the top 110. This urges the bolt 105 to a downstream position as well. It should be noted that the term bolt refers to a member of any cross-section. While a cylindrical bolt is shown, this is for illustrative purposes only and should not be deemed limiting. The bolt 105, as shown below, extends downstream of the downstream side of the top 110. Thus, the bolt 105 is visible, extends outward from the top 110, and interacts with the lid 101.

Figure 3:
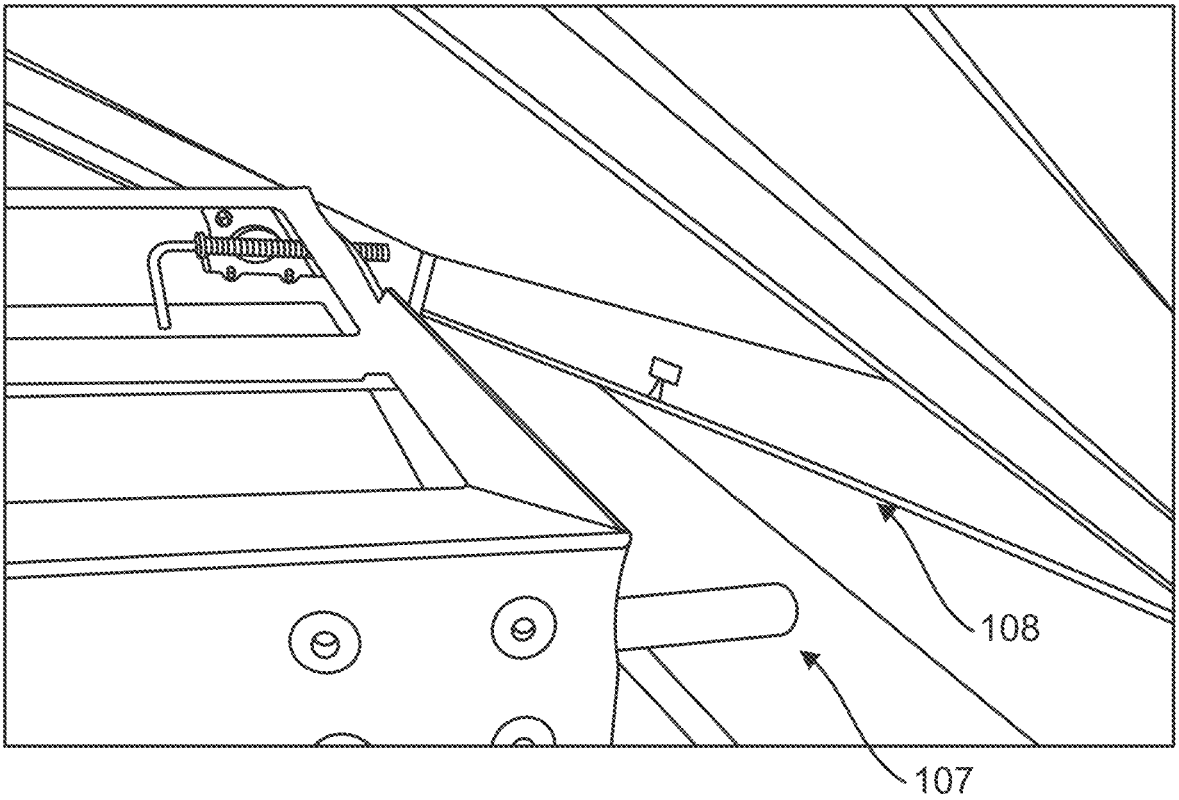
FIG. 3 is a perspective view of the lid in one embodiment.

FIG. 3 is a perspective view of the lid in one embodiment. As shown, the bolt 105 extends downstream of the feeder. An exposed portion 107 of the bolt 105 is visible.

As discussed above, the lid 101 has a lid top and four sides. The downstream side 104, as depicted, has a lip 108. The lip 108 is a protrusion, shelf, or lip, which protrudes inwardly from the downstream side 104. In one embodiment, the lip 108 extends approximately perpendicular to the downstream side 104. The lip 108 interacts with the exposed portion 107 of the bolt 105. Due to the presence of the lip 108, the lid 101 cannot be moved vertically in the upward direction as the exposed portion 107 hits the lip 108. The lip 108, therefore, acts with the exposed portion 107 of the bolt and prevents upward movement of the lid 101. The lip 108, in some embodiments, is positioned so that it is below the exposed portion 107 of the bolt 105. This prevents upward movement of the lid 101 on the downstream side 104.

The size of the lip 108 can vary depending upon the size of the lid 101, the bolt 105, etc. In one embodiment the lip 108 is about 1.3 inches. It can range from about 0.5 to abut 2 inches or greater. These dimensions are for illustrative purposes only and should not be deemed limiting. As shown, the lip 108 extends for the entire length of the downstream end 104.

As shown, there are two bolts 105. One bolt 105 is closer to the front side of the feeder 102, and one bolt is closer to the rear side of the feeder 102. Two bolts 105 allow both the front side and the rear side to be properly locked. In some embodiments, two or more bolts offer additional stability and security for the lid 101. In some embodiments a single bolt 105 will be sufficient to keep a lid 101 in a locked position. However, in some embodiments, especially with larger lids 101, two or more bolts 105 can be utilized. The bolts can extend various lengths downstream of the feeder. In one embodiment, the bolt extends about 0.5 to about 2 inches downstream of the feeder. Various types and sizes of bolts can be utilized. In one embodiment the bolt is about 0.4 inches in diameter. The bolt size can range from 0.25 to 1 inch.

Figure 4:
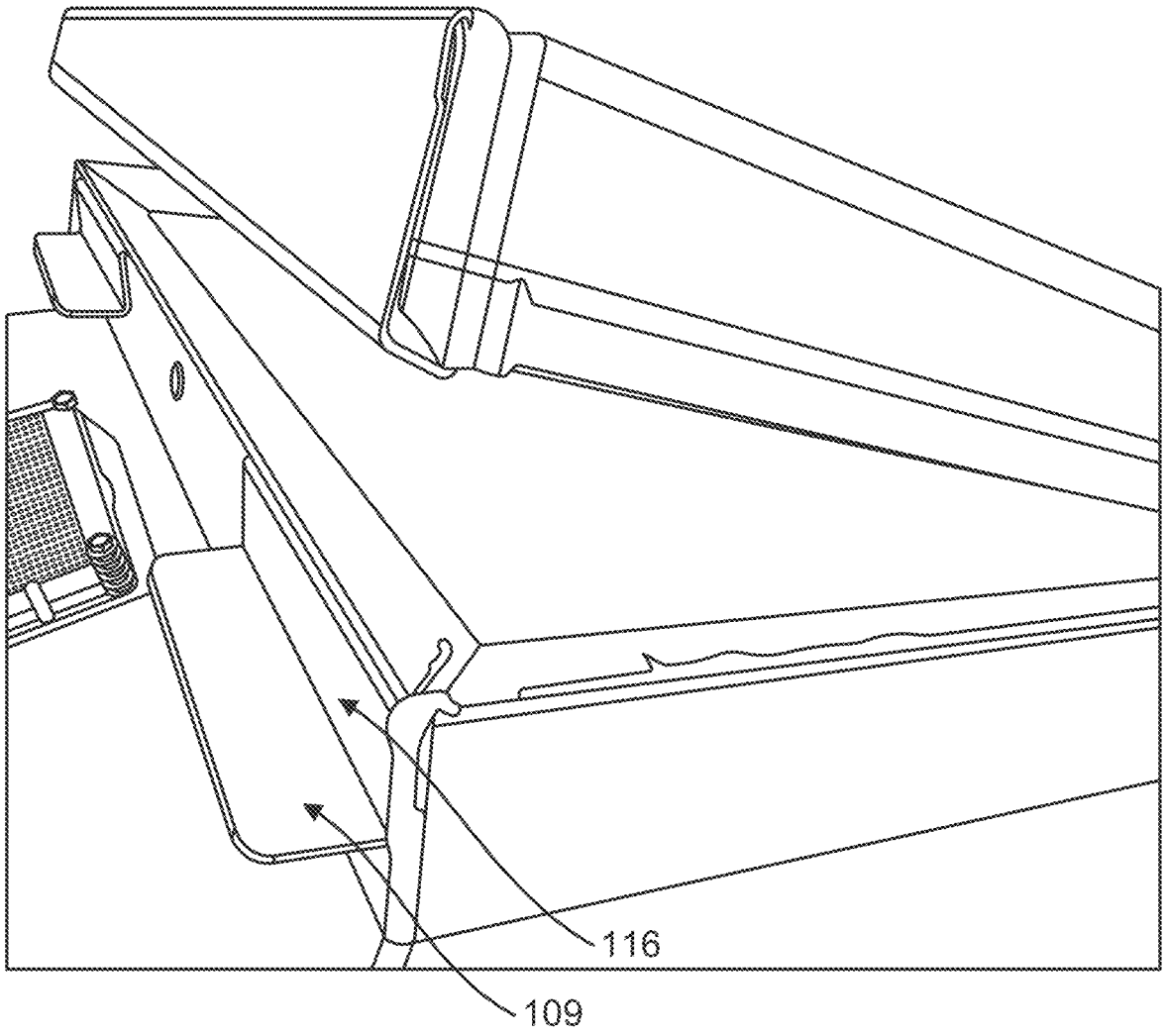
FIG. 4 is a perspective view of the lid in one embodiment.

As noted, the spring 106 urges the bolt 105 downstream. Virtually any type of spring can be utilized. Virtually any object which applies a force can be utilized. In this manner, the exposed portion 107 of the bolt 105 interacts with the lip 108 of the lid 101. This prevents upward movement of the lid 101 in this configuration. To prevent lateral movement of the lid 101, the upstream end of the top 110 comprises one or more shelves 109. FIG. 4 is a perspective view of the lid in one embodiment.

A shelf 109, as depicted, is a protrusion which extends outwardly and in the upstream direction. The shelf 109, like the exposed portion 107 of the bolt 105, engages with a lip 108 on the upstream side of the lid 101. The shelf 108 prevents upward movement of the lid 101 as the shelf 109 engages with the lip 108. Further, the shelf 108 prevents lateral movement of the lid. Thus, when the lid 101 is in the locked position, the shelf 109 is located above the lip 108 on the upstream side of the lid. Simultaneously, the exposed portion 107 of the bolt 105 is located above the lip 108 on the downstream side of the lid.

The size of the shelf 109 can vary depending upon the desired application. In one embodiment the width of the shelf 109 is sufficiently long as to remove any slack or lateral movement of the lid 101. In one embodiment, the shelf 109 is sufficiently wide to ensure the exposed portion 107 of the bolt 105 makes contact with the downstream side of the lid 101. The length of the shelf 109, the distance it extends away from the top of the feeder, can vary. It can range from about 0.5 inches to about 2 inches. In one embodiment it extends about one inch.

As shown there is a plurality of spaced apart shelves 109. As can be seen, the location between shelves 109 provides real estate where a user can grasp and manipulate the lid 101. In usage, to install the lid, the user first secures the downstream end such that the lip 108 is located below the bolt 105. This locks the downstream end in place. Then the user, gripping the upstream end of the lid, applies an upstream force. This compresses the spring 106 on the downstream end. It causes sufficient distance between the shelves 109 and the lip 108 on the upstream end such that the lip 108 can slide beyond the shelves 109. When the user stops applying an upstream force, the spring 106 applies a downstream force which moves the lid 101 slightly downstream. When this occurs, the lip 108 of the upstream end and the shelves 109 now engage, locking the upstream end in place. Simultaneously, the exposed portion 107 of the bolt 105 engages the lip 108 on the downstream side of the lid. Thus, both the upstream and downstream ends of the lid are locked in place. An upward force upon any side will not open the lid.

Instead, to open the lid, the user must apply an upstream force while simultaneously applying an upward force on the upstream end. This move disengages the lip 108 on the upstream end from the shelves 109. The upstream side of the lid 101 can then be lifted upward as shown in FIG. 4. Thereafter, a downstream force can be used to separate the lip 108 on the downstream end from the exposed portion 107 of the bolt 105.

Due to the complex nature of opening the lid 101, such as an upstream force followed by an upward force, the chance that the lid 101 becomes accidentally removed via wind or the like, or intentionally removed by animals is significantly reduced. This ensures the contents of the feeder are properly protected.

The disclosed system has many benefits and advantages. First, in some embodiments no external tools are needed to open or close the lid. Rather than having a lock which secures the lid in place, where the keys can be locked, the lock manufacture, etc., the lid can be essentially locked in place without any external tools or equipment. The user simply opens the lid with a similar moment as before, but instead they apply the necessary upstream and upward movement to allow the lid to be opened. Thus, additional equipment or locks are eliminated. Second, there are many benefits for having a lid which can be locked in a desired closed location. This significantly decreases the likelihood that the lid can be removed due to wind, an animal, etc. This reduces the likelihood that an animal can undesirably retrieve feed from the feeder. It also prevents unwanted spoiling of the contents if the contents were exposed to rain, snow, etc.

As noted, while one application has been described in reference to a feeder, this is for illustrative purposes only and should not be deemed limiting. The system to secure a lid in place can be used for any container with a lid.

While the invention has been particularly shown and described with reference to a preferred embodiment, it will be understood by those skilled in the art that various changes in form and detail may be made therein without departing from the spirit and scope of the invention.

What is claimed is:

1. A system for a lid, said system comprising:

a container with an upstream top and an opposing downstream top;

a lid which couples with said container, wherein said lid comprises an upstream side and an opposing downstream side;

wherein said downstream side comprises an inwardly extending lip, and wherein said upstream side comprises an inwardly extending lip;

wherein said inwardly extending lip on said downstream side extends approximately perpendicular to said downstream side, and wherein said inwardly extending lip extends approximately perpendicular to said upstream side;

wherein said downstream top comprises a moveable bolt which engages with said inwardly extending lip on said downstream side;

wherein said bolt is coupled to a spring to urge the bolt in a downstream position;

wherein said upstream top comprises a shelf which engages with said inwardly extending lip on said upstream side;

wherein said lid comprises a rectangular shape.

2. The system of claim 1 wherein said container is an animal feeder.

3. The system of claim 1 wherein a user can open said lid by applying an upstream and upward force.

4. The system of claim 1 wherein said bolt comprises an exposed portion which extends downstream of said downstream side.

5. The system of claim 4 wherein said exposed portion is greater than 0.5 inches in length.

6. The system of claim 1 wherein said lid comprises a lid top connecting four lid sides.

7. The system of claim 1 wherein said shelf comprises two or more spaced shelves.

8. The system of claim 1 wherein said lip on said downstream side extends greater than one inch inward.

9. The system of claim 1 wherein said shelf has a length of about one inch.

10. The system of claim 1 wherein said lid comprises a square shape, and the top has a square shape.

* * * * *